US010524564B1

(12) United States Patent
Wu

(10) Patent No.: US 10,524,564 B1
(45) Date of Patent: Jan. 7, 2020

(54) TELESCOPIC POST FOR A TABLE

(71) Applicant: TCT Nanotec Co., Ltd., Taichung (TW)

(72) Inventor: Tiger Wu, Taichung (TW)

(73) Assignee: TCT Nanotec Co., Ltd., Taichung (TW)

( * ) Notice: Subject to any disclaimer, the term of this patent is extended or adjusted under 35 U.S.C. 154(b) by 0 days.

(21) Appl. No.: 16/115,719

(22) Filed: Aug. 29, 2018

(51) Int. Cl.
*A47B 9/20* (2006.01)
*A47B 91/02* (2006.01)

(52) U.S. Cl.
CPC ..... *A47B 9/20* (2013.01); *A47B 91/026* (2013.01); *A47B 91/028* (2013.01); *A47B 2200/0054* (2013.01)

(58) Field of Classification Search
CPC ..... A47B 9/04; F16M 11/18
USPC ..... 108/147, 144.11, 147.19; 248/404, 405, 248/161, 188.4, 422
See application file for complete search history.

(56) References Cited

U.S. PATENT DOCUMENTS 3,908,565 A * 9/1975 Burnett ..... A47B 9/04 108/103
4,552,403 A * 11/1985 Yindra ..... A61G 13/02 108/147
5,224,429 A * 7/1993 Borgman ..... A47B 9/00 108/147
5,259,326 A * 11/1993 Borgman ..... A47B 9/00 108/147
5,282,593 A * 2/1994 Fast ..... A47B 9/04 108/147
5,323,695 A * 6/1994 Borgman ..... A47B 9/00 108/147
5,447,099 A * 9/1995 Adams ..... A47B 9/04 108/147
5,483,903 A * 1/1996 Pierce ..... A47B 9/04 108/108
5,601,037 A * 2/1997 Meyer ..... A47B 9/04 108/147
6,131,870 A * 10/2000 Tseng ..... A47B 9/04 108/147
6,148,741 A * 11/2000 Motta ..... A47B 9/04 108/147
6,289,825 B1 * 9/2001 Long ..... A47B 9/00 108/147
6,378,446 B1 * 4/2002 Long ..... A47B 9/02 108/147

(Continued)

*Primary Examiner* — Jose V Chen
(74) *Attorney, Agent, or Firm* — Alan D. Kamrath; Mayer & Williams PC

(57) ABSTRACT

A telescopic post includes a tube set, a power unit, a rotation unit, a threaded tube unit and a threaded rod unit. The tube set includes internal tube inserted in an intermediate tube inserted in an external tube. The power unit is supported on the internal tube. The rotation unit is inserted in the internal tube. The rotation unit is connected to the power unit so that the power unit drives the rotation unit. The threaded tube unit is connected to the rotation unit so that the rotation unit rotates the threaded tube unit. The threaded tube unit is connected to the internal tube so that the threaded tube unit translates the internal tube. The threaded rod unit is connected to the threaded tube unit and the intermediate tube so that the threaded tube unit rotates the threaded rod unit and the threaded rod unit translates the intermediate tube.

17 Claims, 10 Drawing Sheets

(56) References Cited

U.S. PATENT DOCUMENTS

| | | | | |
|---|---|---|---|---|
| 6,435,048 | B1 * | 8/2002 | Zimmerman | A47B 9/04 108/147 |
| 6,494,005 | B2 * | 12/2002 | Zimmerman | B66F 3/10 108/147 |
| 7,487,690 | B2 * | 2/2009 | Liu | A47B 9/04 108/147 |
| 8,347,793 | B2 * | 1/2013 | Cummins | F16F 9/54 108/57.12 |
| 2008/0178779 | A1 * | 7/2008 | Agee | A47B 9/04 108/147 |
| 2009/0121100 | A1 * | 5/2009 | Waidelich | A47B 9/04 248/188.4 |
| 2011/0048291 | A1 * | 3/2011 | Long | A47B 9/02 108/147 |
| 2014/0103174 | A1 * | 4/2014 | Koder | A47B 9/04 248/188.5 |
| 2015/0007756 | A1 * | 1/2015 | Kollreider | A47B 9/04 108/21 |
| 2015/0047538 | A1 * | 2/2015 | Ergun | A47B 9/02 108/147 |
| 2016/0088930 | A1 * | 3/2016 | Hansen | F16F 9/0245 108/147 |
| 2017/0051869 | A1 * | 2/2017 | Hsiao | F16M 11/26 |
| 2018/0140087 | A1 * | 5/2018 | Wu | A47B 9/20 |
| 2018/0172062 | A1 * | 6/2018 | Hu | A47B 9/04 |

* cited by examiner

TELESCOPIC POST FOR A TABLE

BACKGROUND OF INVENTION

1. Field of Invention

The present invention relates to a table and, more particularly, to a telescopic post for a table.

2. Related Prior Art

A table can be equipped with a telescopic post to allow adjustment of the elevation of the table. The telescopic post includes an internal tube inserted in the external tube. The telescopic post can be equipped with a lifting apparatus that includes a worm unit for connecting a driver to a transmission unit. The worm unit includes a worm engaged with a worm gear. The transmission unit includes a single threaded rod for translating the internal tube relative to the external tube, thereby lifting or lowering the table.

The threaded rod is made long to render the range of the elevation of the table large. However, it takes a long period of time to adjust the elevation of the table when the threaded rod is long.

The present invention is therefore intended to obviate or at least alleviate the problems encountered in prior art.

SUMMARY OF INVENTION

It is the primary objective of the present invention to provide a table with telescopic post of which the length is efficiently adjustable.

To achieve the foregoing objective, the telescopic post includes a tube set, a power unit, a rotation unit, a threaded tube unit and a threaded rod unit. The tube set includes internal tube inserted in an intermediate tube inserted in an external tube. The power unit is supported on the internal tube. The rotation unit is inserted in the internal tube. The rotation unit is connected to the power unit so that the power unit drives the rotation unit. The threaded tube unit is connected to the rotation unit so that the rotation unit rotates the threaded tube unit. The threaded tube unit is connected to the internal tube so that the threaded tube unit translates the internal tube. The threaded rod unit is connected to the threaded tube unit and the intermediate tube so that the threaded tube unit rotates the threaded rod unit and the threaded rod unit translates the intermediate tube.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 10:
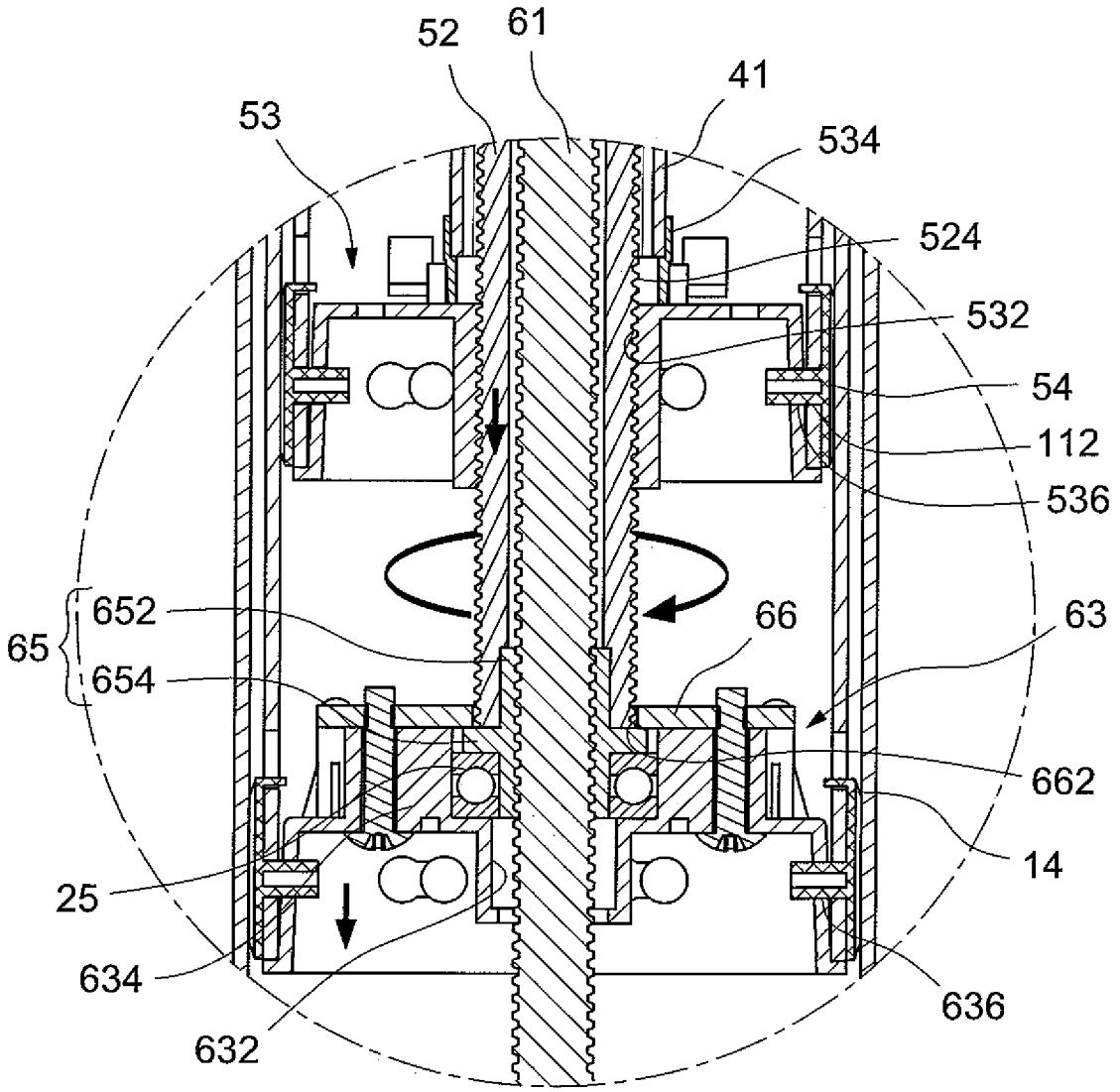
FIG. 10 is an enlarged partial view of the telescopic post shown in FIG. 9.
Figure 11:
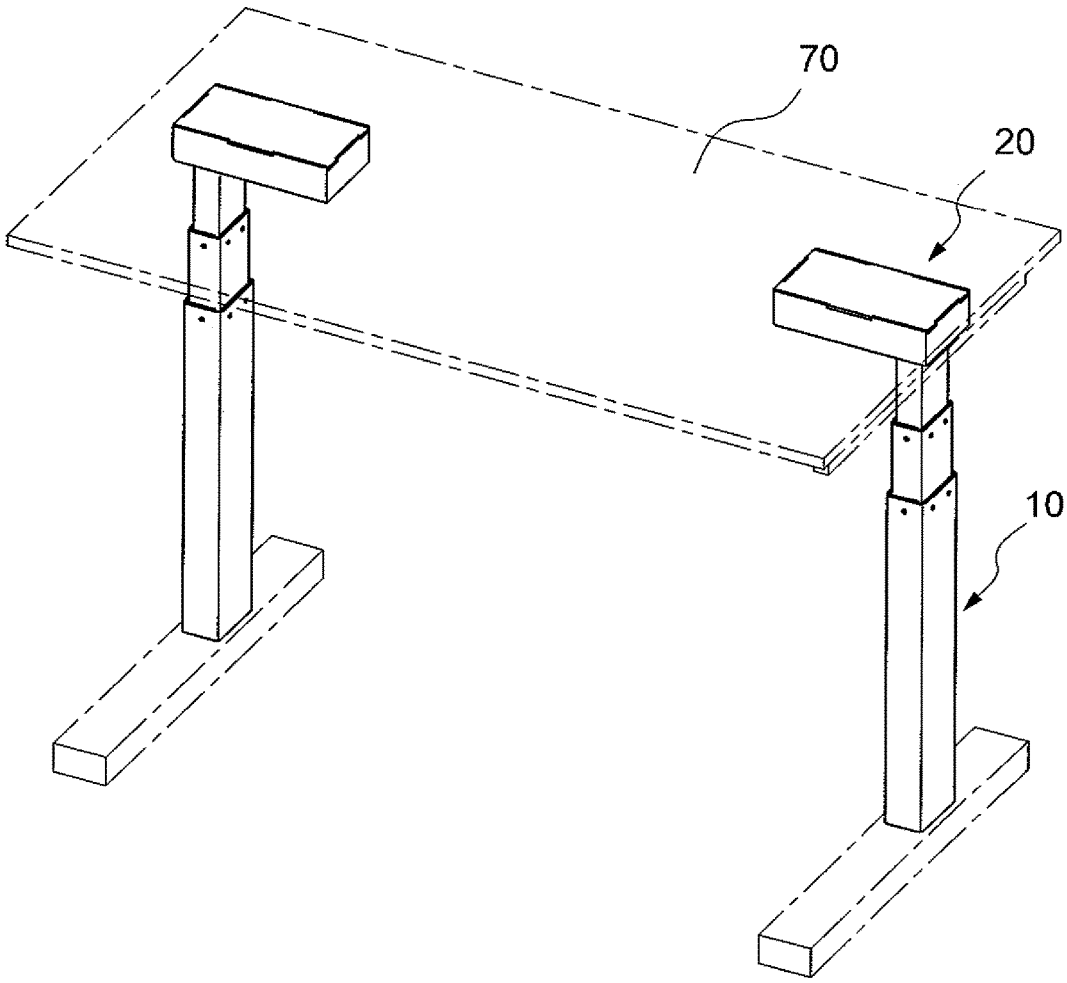
FIG. 11 is a perspective view of a table equipped with two telescopic posts as the one shown in FIG. 1.

Referring to FIG. 11, a table 70 is connected to and supported by two telescopic posts according to the preferred embodiment of the present invention. Referring to FIGS. 1 through 10, detailed description will be given to only one such telescopic post. The telescopic post includes a tube set 10, a power unit 20, a rotation unit 40, a threaded tube unit 50 and a threaded rod unit 60.

Figure 1:
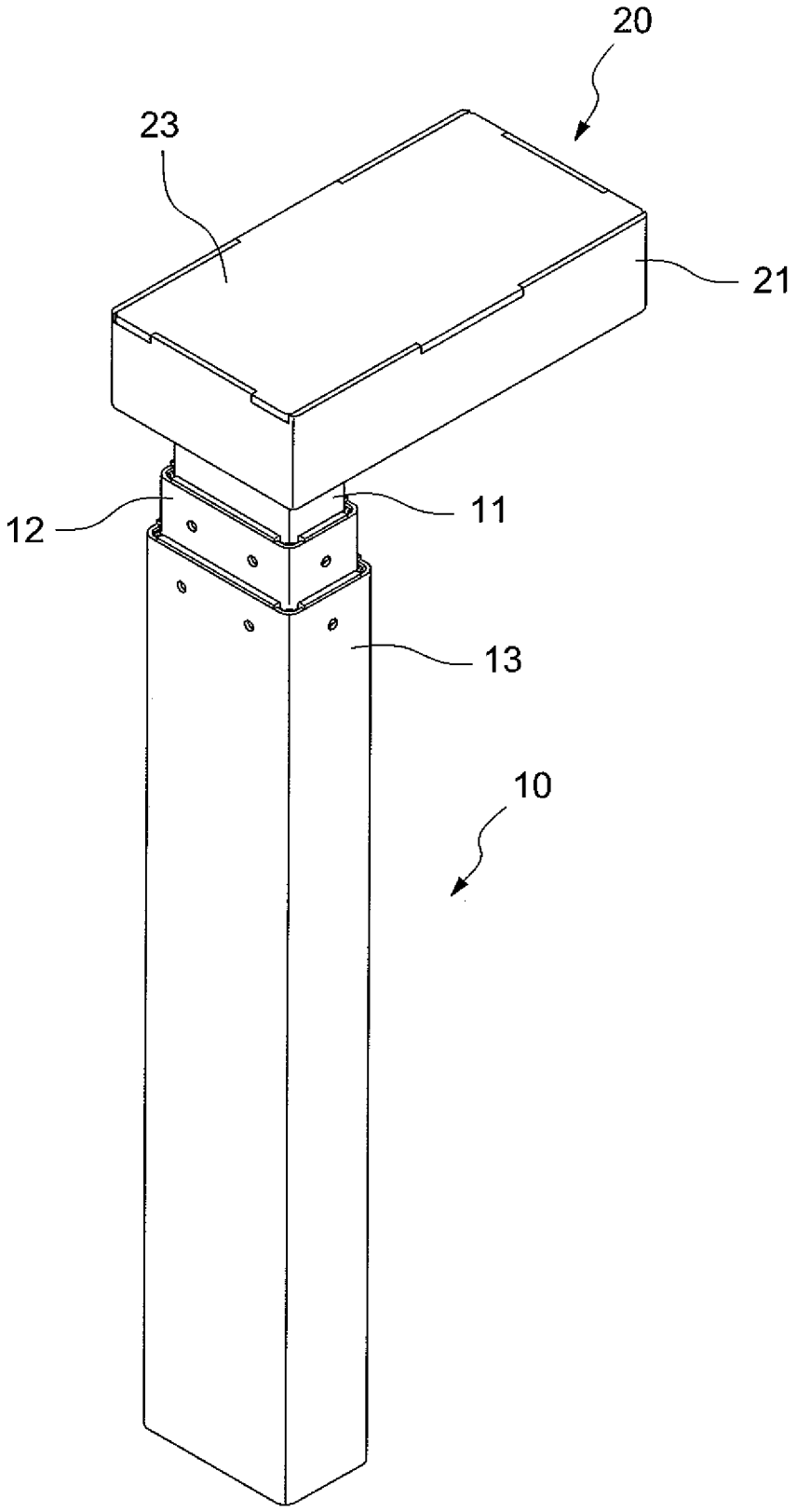
FIG. 1 is a perspective view of a telescopic post according to the preferred embodiment of the present invention.
Figure 2:
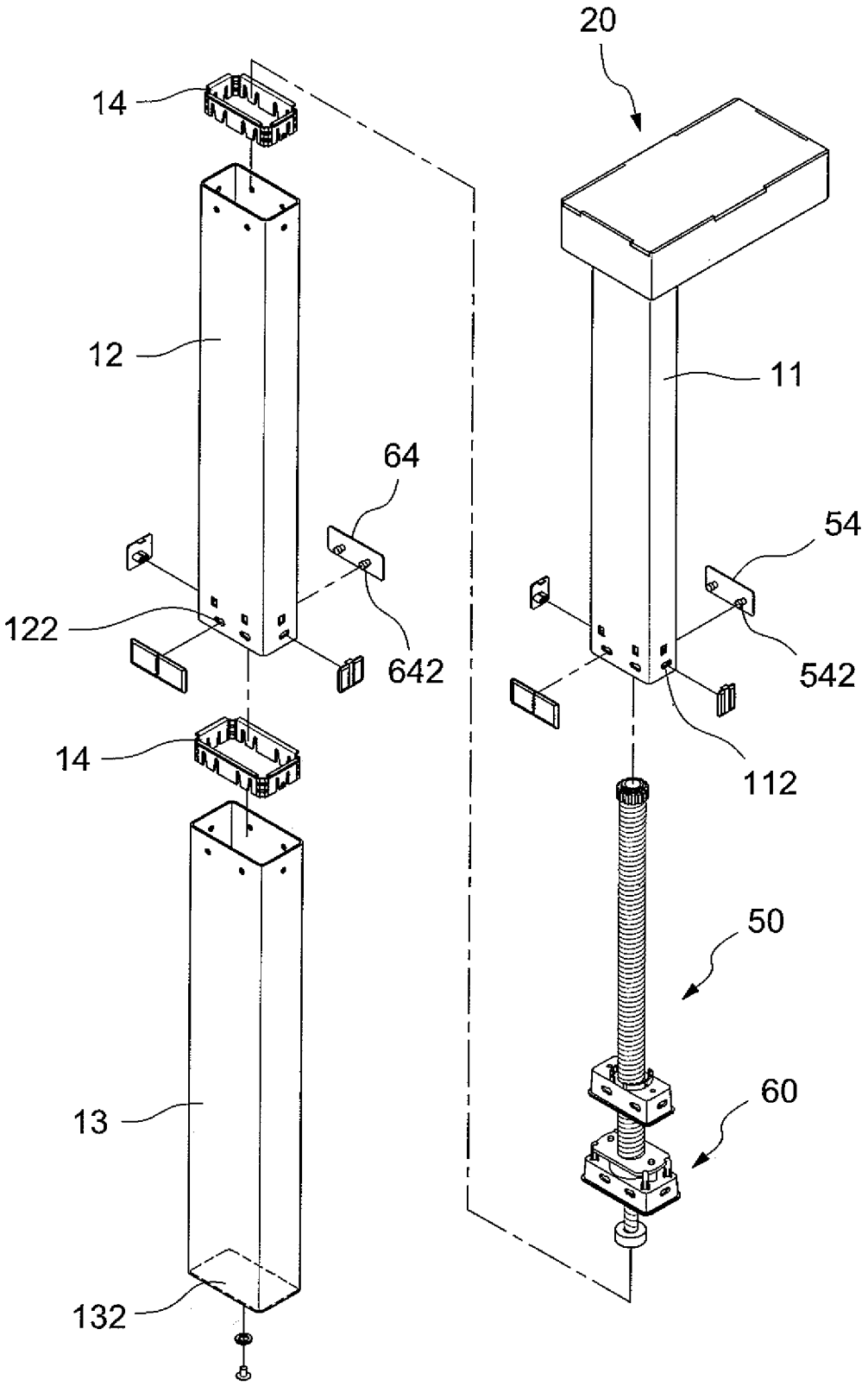
FIG. 2 is an exploded view of the telescopic post shown in FIG. 1.
Figure 3:
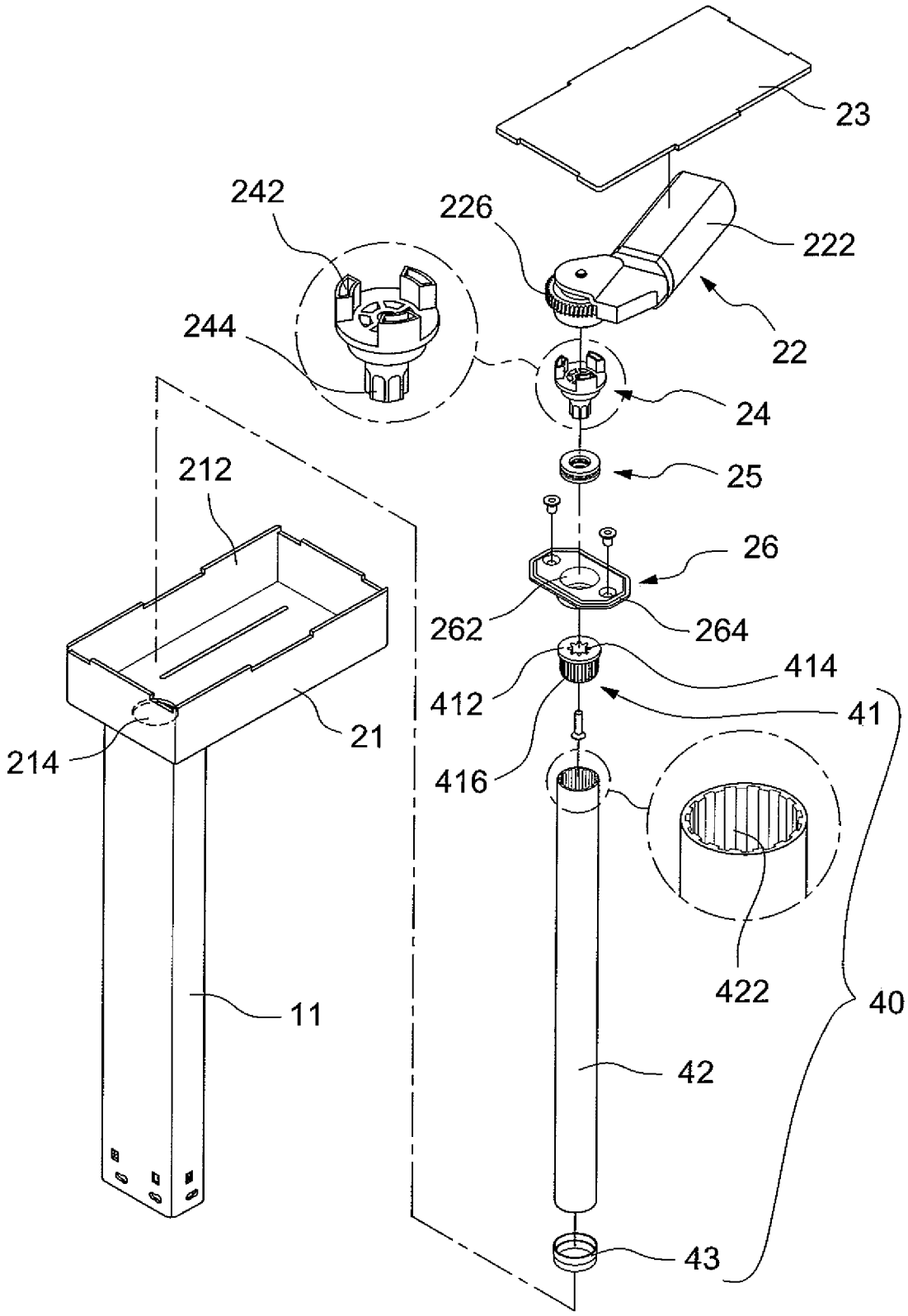
FIG. 3 is an enlarged partial view of the telescopic post shown in FIG. 2.

Referring to FIGS. 1 through 3, the tube set 10 includes an internal tube 11, an intermediate tube 12, an external tube 13 and two linings 14. The internal tube 11 is telescopically inserted in the intermediate tube 12. The intermediate tube 12 is telescopically inserted in the external tube 13. One of the linings 14 is inserted in an upper section of the intermediate tube 12, between the internal tube 11 and the intermediate tube 12. The other lining 14 is inserted in an upper section of the external tube 13, between the intermediate tube 12 and the external tube 13.

The internal tube 11 includes slots 112 extending throughout a wall thereof. The intermediate tube 12 includes slots 122 extending throughout a wall thereof. The external tube 13 includes a bottom plate 132 attached to a lower end thereof, thereby closing the lower end of the external tube 13.

Referring to FIGS. 1 through 4, the power unit 20 includes a box 21, a motor set 22 and a cover 23. The box 21 is connected to an upper end of the internal tube 11, and includes a space 212 and an aperture 214. The space 212 includes an open upper end. The aperture 214 is made in a lower portion of the box 21, in communication with the interior of the internal tube 11.

Figure 4:
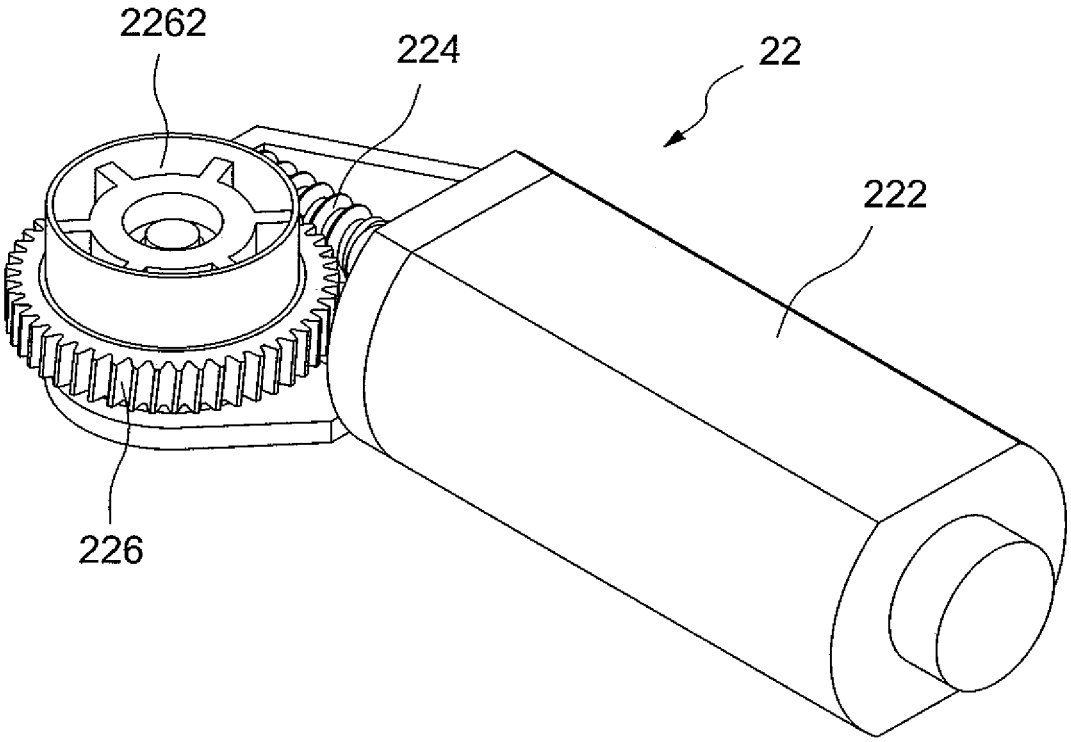
FIG. 4 is a perspective view of a power unit used in the telescopic post shown in FIG. 1.

The motor set 22 is inserted in the space 212. Referring to FIG. 4, the motor set 22 includes a motor 222, a worm 224 and a worm gear 226. The motor 222 is operatively connected to the worm 224. The worm gear 226 is engaged with the worm 224. The worm gear 226 includes several recesses 2262 corresponding to the aperture 214.

The cover 23 is provided on the box 21, thereby closing the open upper end of the space 212.

The joint 24 includes several bosses 242 and a non-circular insert 244. The non-circular insert 244 includes splines for example. The bosses 242 and the non-circular insert 244 are located on two opposite sides of the joint 24. Each of the bosses 242 is inserted in a corresponding one of the recesses 2262 so that the joint 24 is rotatable together with the warm gear 226.

The bearing 25 is provided around a section of the joint 24 near the non-circular insert 244. The bearing 25 is operable to render the rotation of the joint 24 smooth.

The supporting element 26 includes a bowl 262 and a flange 264. The flange 264 extends around an upper edge of the bowl 262. The bowl 262 is inserted in the aperture 214.

The joint 24 and the bearing 25 are inserted in the bowl 262. The non-circular insert 244 of the joint 24 extends throughout the bowl 262. The flange 264 is located on an upper face of the lower portion of the box 21. The flange 264 is connected to the lower portion of the box 21 by screws for example.

Referring to FIG. 3, the rotation unit 40 extends throughout the internal tube 11. The rotation unit 40 includes a plug 41, a hollow shaft 42 and a collar 43. The plug 41 is fitted in an upper section of the hollow shaft 42, and includes a flange 412, a non-circular aperture 414 and a splined section 416. The flange 412 extends around an upper section of the plug 41, and is abutted against an upper end of the hollow shaft 42. The non-circular aperture 414 extends throughout the plug 41. The non-circular aperture 414 is made in compliance with the non-circular insert 244 of the joint 24 so that the plug 41 is rotatable together with the joint 24 when the non-circular insert 244 is inserted in the non-circular aperture 414.

The hollow shaft 42 includes a splined passage 422 axially extending throughout the hollow shaft 42. The splined passage 422 is made in compliance with the splined section 416 of the plug 41 so that the hollow shaft 42 is rotatable together with the plug 41 when the splined section 416 of the plug 41 is inserted in the splined passage 422 of the hollow shaft 42.

The collar 43 is provided around and connected to a lower section of the hollow shaft 42.

Figure 5:
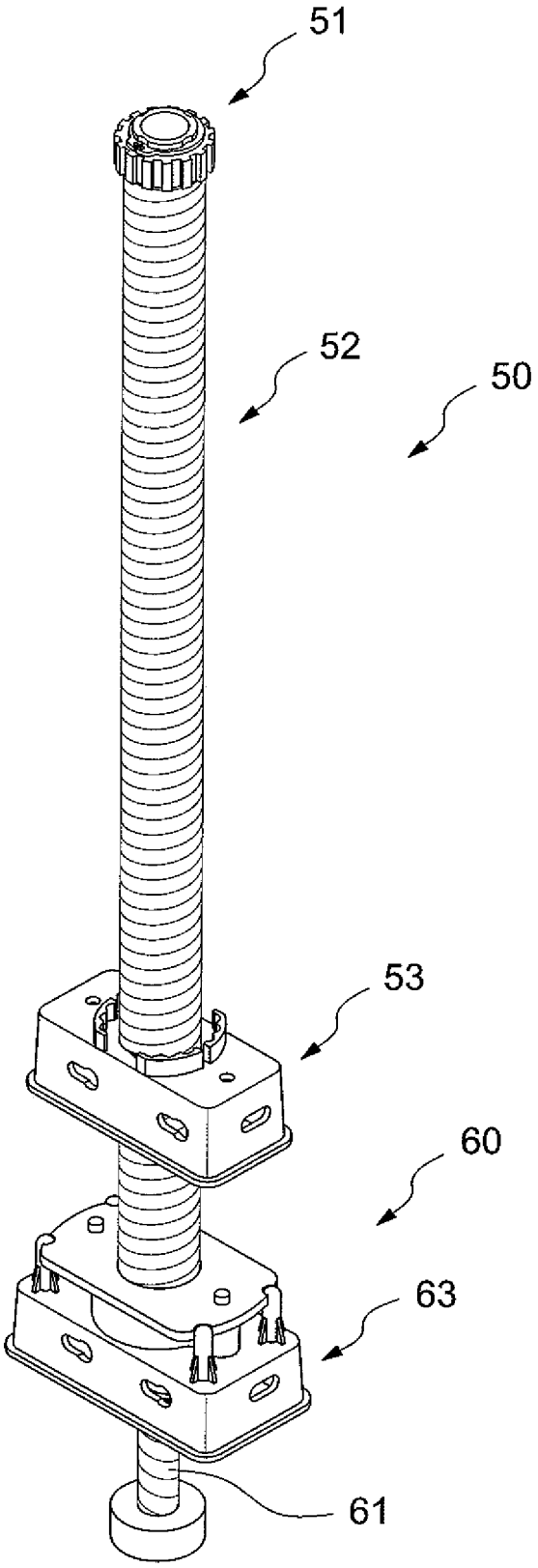
FIG. 5 is another enlarged partial view of the telescopic post than FIG. 3.
Figure 6:
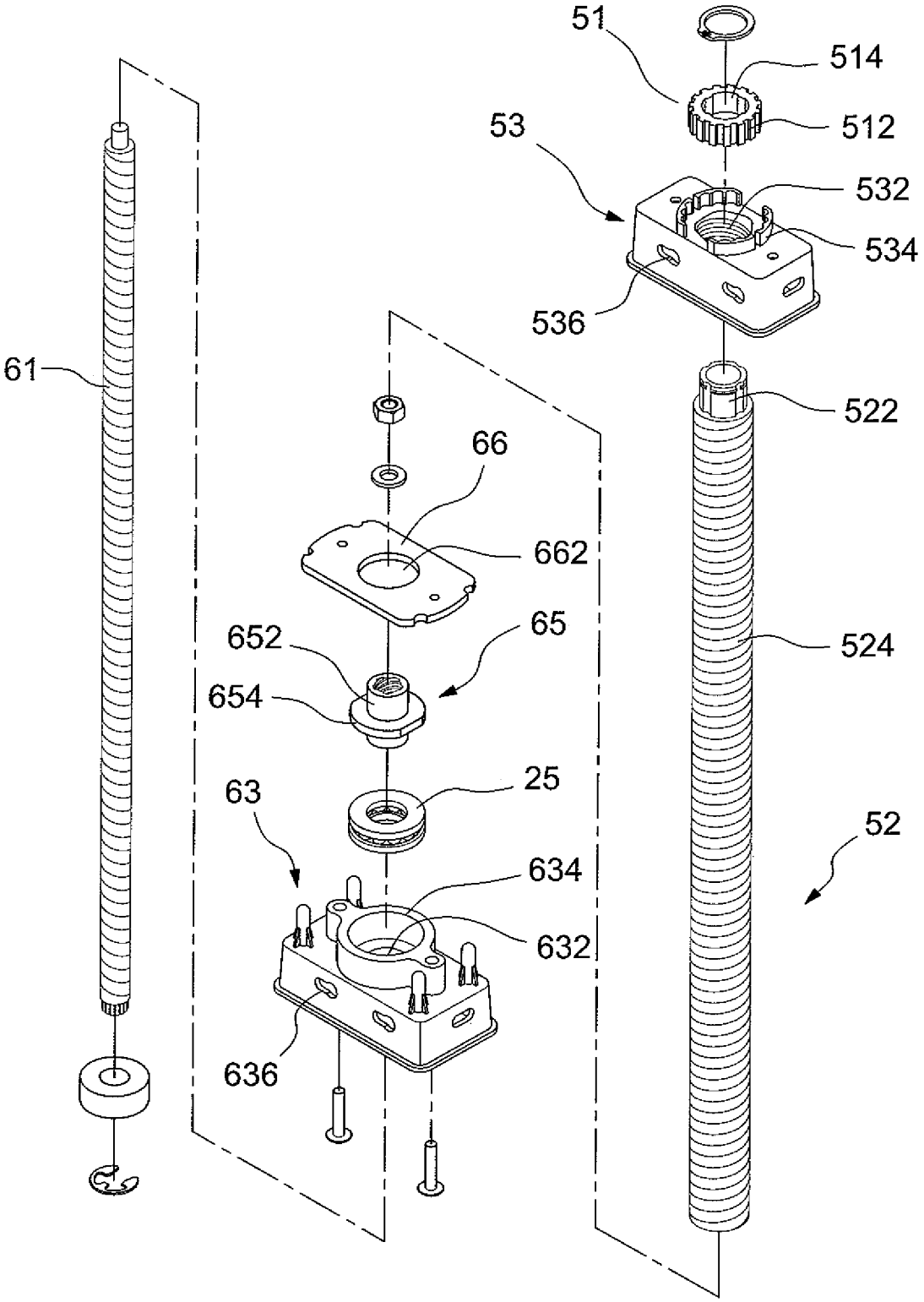
FIG. 6 is another enlarged partial view of the telescopic post than FIG. 5.
Figure 7:
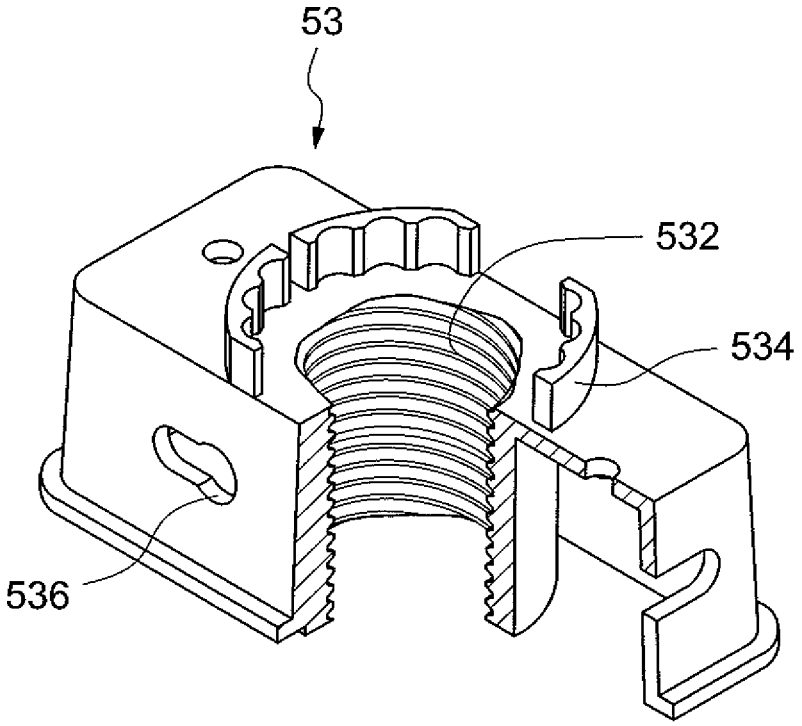
FIG. 7 is an enlarged perspective view of an upper carrier used in the telescopic post shown in FIG. 2.
Figure 8:
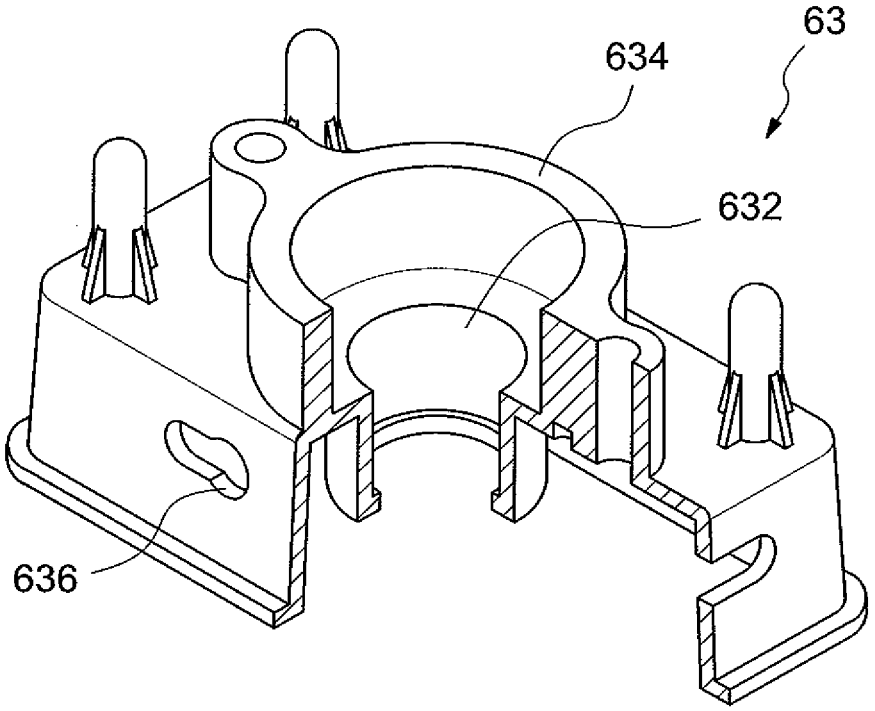
FIG. 8 is an enlarged perspective view of a lower carrier used in the telescopic post shown in FIG. 2.

Referring to FIGS. 2, 5 and 7, the threaded tube unit 50 includes a ring 51, a threaded tube 52, a carrier 53 and several wear-proof plates 54. The ring 51 includes a splined periphery 512 and a non-circular aperture 514. The ring 51 is inserted in the hollow shaft 42. In specific, the splined periphery 512 of the ring 51 is inserted in the splined passage 422 of the hollow shaft 42. Thus, the ring 51 is allowed to move up and down in and along the hollow shaft 42; however, the ring 51 is not allowed to rotate relative to the hollow shaft 42.

The threaded tube 52 includes a non-circular section 522 and a thread 524. The non-circular section 522 is formed on an upper section of an external face of the thread 524. The thread 524 is preferably a left-hand thread extending on an internal face of the threaded tube 52. The non-circular section 522 is inserted in the non-circular aperture 514, thereby rendering the threaded tube 52 not rotatable relative to the ring 51.

The carrier 53 is inserted in a lower section of the internal tube 11, and includes a screw hole 532, a holder 534 and several slots 536. The screw hole 532 extends throughout the carrier 53. The screw hole 532 is preferably a left-hand screw hole engaged with the thread 524 of the threaded tube 52. The holder 534 extends from an upper face of the carrier 53, coaxial with the screw hole 532. The holder 534 receives the collar 43. The slots 536 are made in the periphery of the carrier 53, corresponding to the slots 112.

Each of the wear-proof plates 54 includes several anchors 542 formed on the periphery thereof. The wear-proof plates 54 are located around the internal tube 11. The anchors 542 are inserted in the slots 112 and the slots 536, thereby attaching the wear-proof plates 54 and the carrier 53 to the internal tube 11.

Referring to FIGS. 2, 5, 6, 8 and 9, the threaded rod unit 60 includes a threaded rod 61, a carrier 63, several wear-proof plates 64 and a nut 65. The threaded rod 61 includes a thread 612 that is preferably a right-hand thread. The threaded rod 61 is rotationally inserted in the threaded tube 52. A lower end of the threaded rod 61 is connected to the bottom plate 132 of the external tube 13 by a screw for example.

The carrier 63 is inserted in a lower section of the intermediate tube 12, and includes an axial aperture 632, a socket 634 and several slots 636. The axial aperture 632 extends throughout the carrier 63. The socket 634 extends on an upper face of the carrier 63, coaxial with the axial aperture 632. The socket 634 receives the bearing 25. The slots 636 are made in the periphery of the intermediate tube carrier 63, corresponding to the slots 122.

Each of the wear-proof plates 64 includes several anchors 642. The wear-proof plates 64 are located around the intermediate tube 12. The anchors 642 are inserted in the slots 122 and the slots 636, thereby attaching the wear-proof plates 64 and the carrier 63 to the intermediate tube 12.

The nut 65 includes a screw hole 652 and a flange 654. The screw hole 652 is axially made in the nut 65. The screw hole 652 is preferably a right-hand screw hole. The flange 654 extends around a middle section of an eternal face of the nut 65. An upper section of the nut 65 is fitted in the lower section of the threaded tube 52 so that the nut 65 is not rotatable relative to the threaded tube 52. A lower section of the nut 65 is inserted in the bearing 25.

The cover 66 includes an aperture 662. The cover 66 is connected to an upper end of the socket 634, thereby keeping the lower section of the nut 65 and the flange 654 in the carrier 63, yet allowing the nut 65 to rotate relative to the carrier 63. The aperture 662 is coaxial with the axial aperture 632. The upper section of the nut 65 is fitted in the lower section of the threaded tube 52 through the aperture 662, thereby rendering the nut 65 rotatable together with the threaded tube 52.

The features of the elements of the telescopic post and their interconnection have been described above. The operation of the telescopic post will be described.

Referring to FIG. 11, the upper end of the power unit 20 is connected to a lower face of a table 70. The length of the telescopic post is adjustable so that the elevation of the table 70 is changeable.

Figure 9:
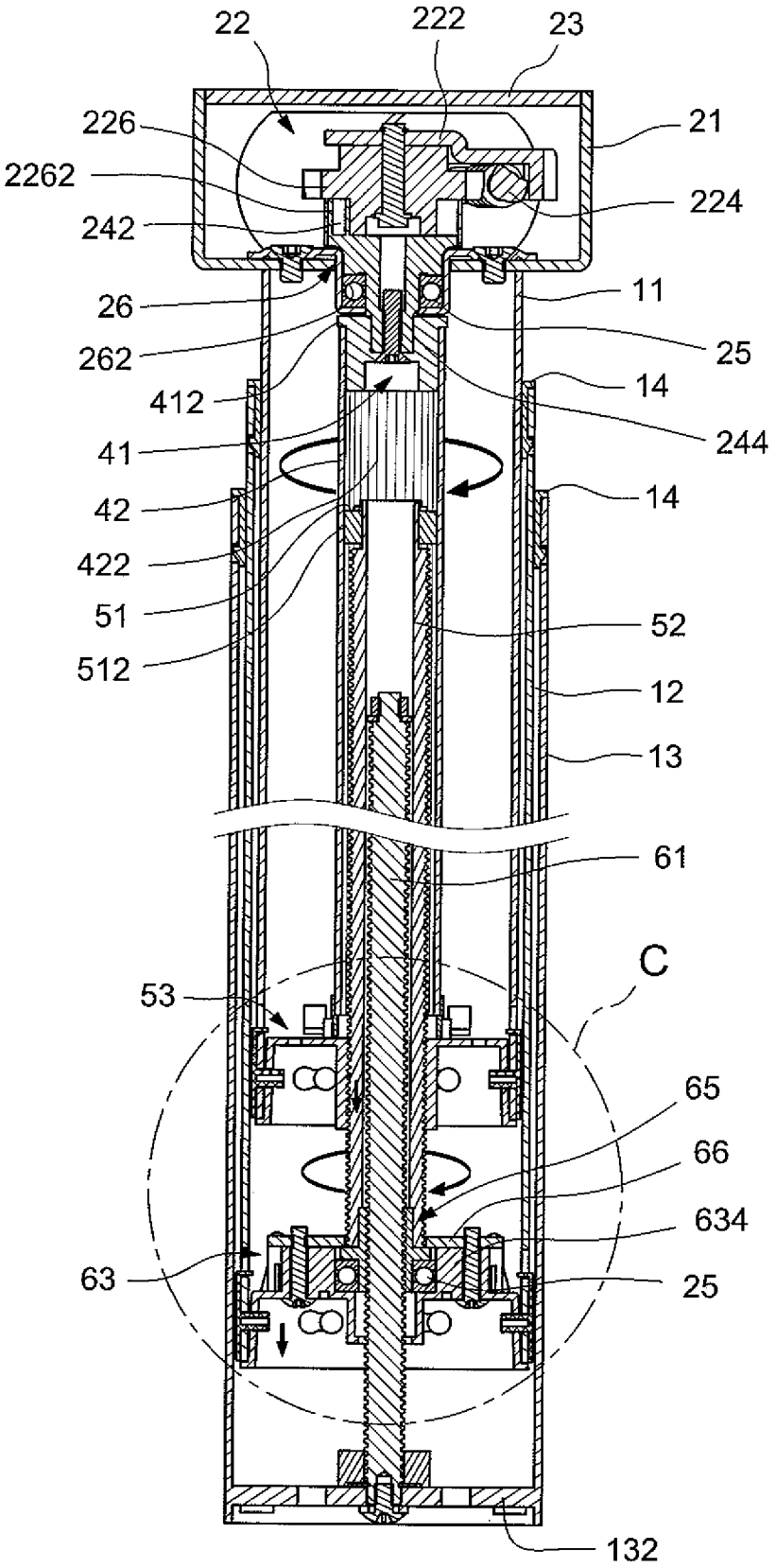
FIG. 9 is a cross-sectional view of the telescopic post shown in FIG. 1.

Referring to FIGS. 9 and 10, to lower the table 70, the motor 222 of the power unit 20 is actuated to drive the joint 24 in a sense of direction. Thus, the plug 41 of the rotation unit 40, which is provided on the non-circular insert 244 of the joint 24, rotates. The plug 41 rotates the hollow shaft 42. The hollow shaft 42 rotates the ring 51 since the splined periphery 512 of the ring 51 is inserted in the splined passage 422 of the hollow shaft 42. The ring 51 rotates the threaded tube 52 because the splined periphery 512 of the ring 51 is inserted in the splined passage 422 of the hollow shaft 42.

The threaded tube 52 rotates the nut 65 because the upper section of the nut 65 is fitted in the lower section of the threaded tube 52. The nut 65 rotates and descends relative to the threaded rod 61. The nut 65 lowers the carrier 63 since the nut 65 is kept in the carrier 63 by the cover 66. The carrier 63 lowers the intermediate tube 12 since the intermediate tube 12 is connected to the carrier 63 by the anchors 642 of the wear-proof plates 64.

Synchronously, the threaded tube 52 rotates relative to the carrier 53 so that the carrier 53 descends relative to the threaded tube 52. The carrier 53 lowers the internal tube 11 because the internal tube 11 is connected to the carrier 53 by the anchors 542 of the wear-proof plates 54.

To lift the table 70, the motor 222 of the power unit 20 is actuated to drive the joint 24 in an opposite sense of direction.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A telescopic post comprising:

a tube set comprising an external tube, an intermediate tube inserted in the external tube and an internal tube inserted in the intermediate tube;

a power unit supported on the internal tube and comprising:

a box supported on the internal tube and comprising a lower portion formed with an aperture;

a supporting element comprising a bowl and a flange extending from and around the bowl, wherein the flange is inserted in the box and supported on the lower portion of the box while the bowl extends from the box via the aperture;

a motor inserted in the box;

a worm connected to the motor;

a worm gear engaged with the worm and comprising recesses in a lower face;

a bearing inserted in the bowl; and a joint supported by the bearing and comprising an upper end formed with bosses inserted in the recesses of the worm gear and a lower end extending from the box via the aperture;

a rotation unit inserted in the internal tube and comprising a hollow shaft connected to the second end of the joint so that the power unit drives the rotation unit;

a threaded tube unit connected to the rotation unit so that the rotation unit rotates the threaded tube unit wherein the threaded tube unit is connected to the internal tube so that the threaded tube unit translates the internal tube; and a threaded rod unit connected to the external tube at a portion, connected to the threaded tube unit at another portion and connected to the intermediate tube at another portion so that the threaded tube unit translates the intermediate tube relative to the external tube via the threaded rod unit.

2. The telescopic post according to claim 1, wherein the threaded tube unit comprises:

a threaded tube connected to the rotation unit so that the rotation unit rotates the threaded tube; and an upper carrier connected to the internal tube and comprising a screw hole that receives the threaded tube so that threaded tube translates the internal tube via the upper carrier.

3. The telescopic post according to claim 1, wherein the joint comprises a non-circular insert inserted in the hollow shaft.

4. The telescopic post according to claim 3, wherein the rotation unit further comprises a plug fitted in the hollow shaft, and formed with a non-circular aperture that receives the non-circular insert.

5. The telescopic post according to claim 4, wherein the plug further comprises a splined section, wherein the hollow shaft comprises a splined passage that receives the splined section.

6. The telescopic post according to claim 2, wherein the hollow shaft comprises a splined passage, wherein the threaded tube comprises a splined section inserted in the splined passage.

7. The telescopic post according to claim 2, wherein the hollow shaft comprises a splined passage, wherein the threaded tube unit comprises a ring comprising a splined periphery inserted in the splined passage and a non-circular aperture, wherein the threaded tube comprises a non-circular section inserted in the non-circular aperture.

8. The telescopic post according to claim 7, wherein the threaded tube unit further comprises wear-proof plates each of which comprises a side connected to the internal tube and an opposite side in contact with the intermediate tube.

9. The telescopic post according to claim 8, wherein the internal tube comprises slots, wherein the upper carrier comprises slots, wherein each of the wear-proof plates comprises anchors inserted in the slots of the internal tube via the slots of the upper carrier.

10. The telescopic post according to claim 2, wherein the threaded rod unit comprises:

a threaded rod connected to the external tube; and a nut engaged with the threaded rod so that the nut is allowed to rotate and translate relative to the threaded rod, wherein the nut is connected to the threaded tube so that the threaded tube rotates the nut wherein the nut is connected to the intermediate tube so that the nut translates the intermediate tube.

11. The telescopic post according to claim 10, wherein the threaded rod comprises a thread extending in a sense of direction, wherein the threaded tubes comprises a thread extending in an opposite sense of direction.

12. The telescopic post according to claim 10, wherein the threaded rod unit further comprises a lower carrier so that the nut translates the lower carrier and that the nut is rotatable in the lower carrier, wherein the lower carrier is connected to the intermediate tube so that the lower carrier translates the intermediate tube.

13. The telescopic post according to claim 10, wherein the lower carrier comprises a socket that contains the nut and a cover connected to the socket to keep the nut in the socket.

14. The telescopic post according to claim 13, wherein the nut comprises a flange located between the lower carrier and the cover.

15. The telescopic post according to claim 13, wherein the lower carrier further comprises an axial aperture and in communication with the socket, wherein the threaded rod extends throughout the axial aperture and the socket.

16. The telescopic post according to claim 15, wherein the threaded bolt unit further comprises wear-proof plates each of which comprises a side connected to the intermediate tube and an opposite side in contact with the external tube.

17. The telescopic post according to claim 16, wherein the intermediate tube comprises slots, wherein the lower carrier comprises slots, wherein each of the wear-proof plates of the intermediate tube unit comprises anchors inserted in the slots of the lower carrier via the slots of the intermediate tube.

* * * * *